US006508607B1

(12) United States Patent
Smith et al.

(10) Patent No.: US 6,508,607 B1
(45) Date of Patent: Jan. 21, 2003

(54) EROSION CONTROL BLOCK ADAPTED FOR USE WITH CELLULAR CONCRETE MATTRESSES

(76) Inventors: Lee A. Smith, 1202 Berkeley Lake La., Houston, TX (US) 77062; Belinda F. Smith, 1202 Berkeley Lake La., Houston, TX (US) 77062

( * ) Notice: Subject to any disclaimer, the term of this patent is extended or adjusted under 35 U.S.C. 154(b) by 0 days.

(21) Appl. No.: 09/861,701

(22) Filed: May 21, 2001

Related U.S. Application Data

(60) Provisional application No. 60/257,921, filed on Dec. 21, 2000.

(51) Int. Cl.[7] ..... E02B 3/14

(52) U.S. Cl. ..... 405/20; 405/19; 52/603; 52/604; 52/606

(58) Field of Search ..... 405/19, 20, 16, 405/17; 52/603, 604, 606; 404/34, 35, 37, 40, 41

(56) References Cited

U.S. PATENT DOCUMENTS

| | | | | | |
|---|---|---|---|---|---|
| 3,903,702 | A | | 9/1975 | Appleton | |
| 4,201,494 | A | | 5/1980 | Crowe | |
| 4,227,829 | A | * | 10/1980 | Landry, Jr. | 405/20 |
| 4,370,075 | A | * | 1/1983 | Scales | 405/20 |
| 4,372,705 | A | * | 2/1983 | Atkinson | 405/19 |
| 4,474,504 | A | | 10/1984 | Whitman et al. | |
| 4,503,649 | A | | 3/1985 | Sciortino | |
| 4,544,305 | A | | 10/1985 | Hair | |
| 4,564,311 | A | | 1/1986 | Scales | |
| 4,773,790 | A | | 9/1988 | Hagenah | |
| 4,781,492 | A | | 11/1988 | Shindo | |
| 4,973,192 | A | | 11/1990 | Hair | |
| 5,011,327 | A | | 4/1991 | Thiac | |
| 5,020,938 | A | | 6/1991 | Scales | |
| 5,186,574 | A | | 2/1993 | Tavares | |
| 5,429,451 | A | * | 7/1995 | Pettee, Jr. | 405/20 |
| 5,484,230 | A | * | 1/1996 | Rudloff | 405/20 |
| 5,536,111 | A | | 7/1996 | Doernemann | |
| 5,556,228 | A | * | 9/1996 | Smith | 405/16 |
| 5,779,391 | A | * | 7/1998 | Knight | 405/20 |
| 5,906,456 | A | * | 5/1999 | Knight | 405/20 |
| 5,971,658 | A | * | 10/1999 | Pramono et al. | 405/21 |
| 6,071,041 | A | * | 6/2000 | Knight | 405/16 |
| 6,079,902 | A | * | 6/2000 | Pettee, Jr. | 405/35 |
| 6,276,870 | B1 | * | 8/2001 | Smith | 405/17 |

FOREIGN PATENT DOCUMENTS

| | | | | |
|---|---|---|---|---|
| DE | 0 016 727 A1 | | 10/1980 | |
| GB | 2139676 A | * | 11/1984 | E02B/3/04 |
| JP | 59224710 A | * | 12/1984 | E02B/3/14 |

OTHER PUBLICATIONS

DURA–MAT Interlocking Erosion Control System, Brochure, 2 pages, 1991.

(List continued on next page.)

*Primary Examiner*—Robert E. Pezzuto
*Assistant Examiner*—Alexandra K. Pechhold
(74) *Attorney, Agent, or Firm*—Roger N. Chauza, Esq.; Chauza & Handley, L.L.P.

(57) ABSTRACT

A block having a semicircular male lobe and a semicircular female recess on opposing sides thereof. On other opposing sides of the block, there is formed a side edge shape such that when neighboring blocks are placed together, a circuitous water channel is formed between the blocks. The block includes cable channels formed therethrough, with the cable channels opening at the side edges into cable cavities. The cable cavities facilitate access to ends of the cables when the blocks are placed side by side.

24 Claims, 7 Drawing Sheets

OTHER PUBLICATIONS

PETRAFLEX Case History, Brochure, 4 pages, 1994.
CONLOCK, World's Most Advanced, Versatile Concrete Interlocking Erosion Control Systems, Brochure, 4 pages, 1995.
PETRAFLEX Petraflex/Keystone Protect Lakeshore For New Park, Brochure, 2 pages, 1996.
PETRAFLEX Lake Worth Canal Revetment, Brochure, 2 pages, 1997.
MIDWEST CONTRACTOR, Boom Town, Magazine, 4 pages, 1997.
PETRATECH, GeoLink, 2 pages, 1998.
CABLE CONCRETE, Articulating Concrete Block, Brochure, 4 pages, 1998.
University of Iowa, Institute of Hydraulic Research, Report, 12 pages, 1988.
CHANNEL–LOCK, Flexible Concrete Revetment, Brochure, 4 pages, undated.
ARMORTEC, Securing The Environment, Brochure, 4 pages, undated.
ARMORLOC, 3510/4511, The Precast Concrete Interlocking Erosion Control Block, Brochure, 2 pages, undated.
PETRAFLEX, The Natural Solution, Brochure, 4 pages, undated.

* cited by examiner

EROSION CONTROL BLOCK ADAPTED FOR USE WITH CELLULAR CONCRETE MATTRESSES

RELATED APPLICATIONS

This nonprovisional patent application claims the benefits of pending provisional patent application bearing the same title, and identified by Ser. No. 60/257,921, filed Dec. 21, 2000.

TECHNICAL FIELD OF THE INVENTION

The present invention relates in general to erosion control blocks, and more particularly to the type of erosion control block that can be cabled together with other similar blocks, and installed as a mattress by a crane and spreader bar.

BACKGROUND OF THE INVENTION

There are numerous types and shapes of erosion control blocks for covering a ground area to prevent erosion of the underlying earth material. An erosion control block is generally constructed of a heavy material, such as concrete, so that the block remains stationary when water flows around or over the block. The shape of erosion control blocks can be made so as to be interlocking, or interengaging, and facilitate the hydraulic stability of the block installed in a waterway, or the like. Interengaging erosion control blocks can be constructed similar to that shown in U.S. Pat. No. 5,484,230 by Rudloff. Interlocking erosion control blocks can be constructed in a manner similar to that shown in U.S. Pat. No. 5,556,228 by Smith. The interlocking type of block prevents lateral removal thereof from another similar block, when moved in any lateral direction. Interengaging erosion control blocks generally provide stability between blocks in one lateral direction, but not a lateral direction perpendicular thereto. The flexibility of interlocking blocks is generally less than that of the interengaging blocks.

Some erosion control blocks are simply installed by workmen carrying the blocks from a pallet and installing the blocks in a side-by-side relationship. A geotextile is generally layed on the ground before the installation of the erosion control blocks. Depending upon the terrain and other factors, the blocks may simply be interengaged or interlocked together. In other situations, the erosion control blocks are installed in an interengaged or interlocking manner, and thereafter cables are threaded therethrough to provide farther stability to the matrix or mattress of blocks.

In accordance with other installation techniques, a matrix of erosion control block can be interengaged or interlocked together at the plant, and cabled as a mattress so as to form a flexible unit. In erosion control blocks fabricated for cabling, two or more cable channels are formed through the blocks so that cables can be threaded therethrough. The mattresses can be lifted by the cables and loaded onto a truck or train. The mattress can then be lifted by the cables off a transport truck, or the like, by a large crane and spreader bar assembly, and moved to the site to be protected from erosion. A cellular concrete mattress of erosion control blocks typically includes a matrix of six blocks by thirty-two blocks, which generally measures eight foot by forty foot. A number of such mattresses are installed together so as to provide full coverage over the terrain to be protected from erosion.

The cabling material is generally a synthetic rope that is threaded through the blocks in an X-direction, as well as a Y-direction, to form the mattress. When installing multiple mattresses of erosion control blocks together, the blocks forming the border of the adjacent mattress are anchored together by splicing the cables. In other words, the end of a cable threaded through the border block of one mattress is spliced to the end of the other cable threaded through the border block of the adjacent mattress. The splicing of the two cable ends includes the utilization of an aluminum sleeve into which the end of each cable is inserted, and then two crimps are made to fasten the cable ends together via the sleeve. It can be appreciated that the border blocks of adjacent mattresses can not be installed in contact with each other, otherwise there would be no room to carry out the splicing operation. As such, the edge or border of one mattress is generally spaced two inches from the border blocks of the adjacent mattress.

The space between mattresses of erosion control blocks creates a channel through which water can flow in an unimpeded manner. Depending upon the environmental conditions, the flow of water through this channel between the mattresses of erosion control blocks can carry soil with it, thereby forming a pocket under the geotextile material. This is especially prevalent where the mattresses of erosion control blocks are laid on inclined channel banks, where the water flow from the top to the bottom of the grade is swift. When erosion of soil under the geotextile occurs, failures in the erosion control system can occur. In some instances, a sufficient amount of soil is removed through erosion under the geotextile, such that the overlying blocks become suspended by the cables, and bridge the void area. Due to the weight of the blocks, the cables can often break and thereby cause a catastrophic erosion condition.

From the forgoing, it can be seen that a need exists for a technique for cabling together erosion control blocks so as to avoid water flow channel areas between the mattresses. Another need exists for a erosion control block itself which facilitates the splicing of cables therebetween as well as reduces the speed or volume per unit time of the water that flows in the channel between mattresses. Yet another need exists for a design of erosion control blocks which, when installed adjacent to each other a distance sufficient to allow splicing of cables therebetween, the flow of water between the border blocks is circuitous, thereby reducing possibilities of erosion. A further need exists for a block design where a space between engaged blocks exists, but when the blocks are lifted by a cable to a catenary position, the block edges engage and load forces between blocks are distributed over a larger area of engagement.

SUMMARY OF THE INVENTION

An erosion control block and the method of installation thereof is described below. In one embodiment, the erosion control block is fabricated with a heavy material, and generally in a rectangular shape. Two opposing side edges of the block have semicircular interengaging members. On one side there is formed a semicircular lobe, and on the opposing edge of the block there is formed a semicircular recess. In one embodiment, the lobe and recess are formed so that when fully interengaged, there exists a space between adjacent blocks. As the blocks are lifted by a cable to a catenary position, the lobe of one block becomes disengaged with the recess of a neighbor block, and the adjacent block corner edges become engaged. The corner edges of the blocks are rounded or beveled to provide a larger surface area to distribute the load forces extended between blocks when suspended in the catenary form.

The other opposing side edges of the erosion control block include edge configurations for providing a circuitous channel when the blocks are installed side-by-side. Two sides edge portions of the erosion control block each include parallel surfaces connected together by an angled edge section. This circuitous channel between adjacent blocks joins the circuitous channel of another adjacent pair of blocks by a lateral water channel. With this arrangement, the channel between the mattress is not straight, but rather is circuitous to thereby impede the flow of water therethrough.

In the described embodiment, two spaced-apart cable channels are formed between two edges of the block, and another pair of space-apart cable channels are formed between the other two opposing edges. The end of each cable channel, where it terminates at the side edge of the block, opens into a cable cavity to thereby accommodate the use of an anchor button and/or splice sleeve on a cable.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, components or elements throughout the views, and in which.

DETAILED DESCRIPTION OF THE INVENTION

Figure 1:
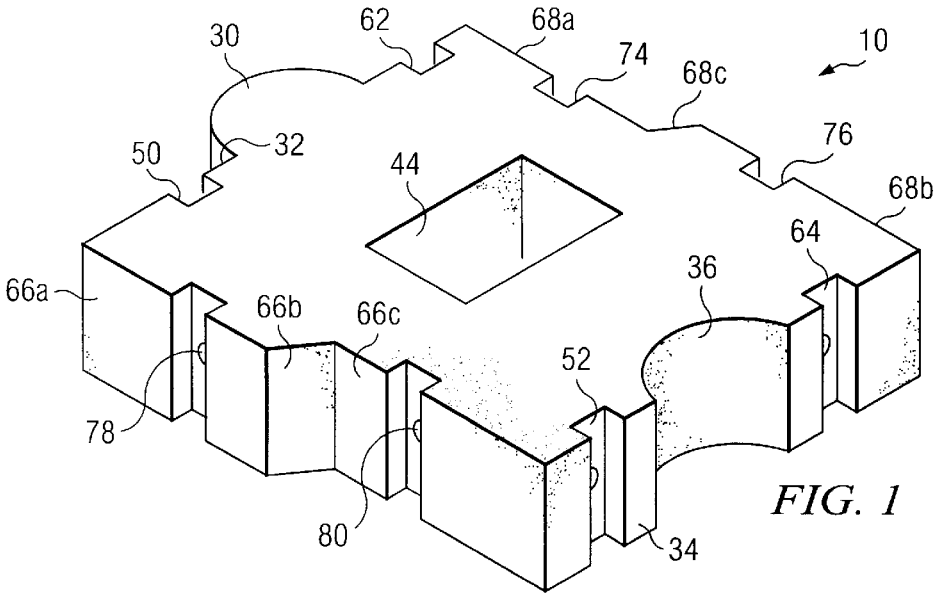
FIG. 1 is an isometric view of an erosion control block constructed according to one embodiment.
Figure 2:
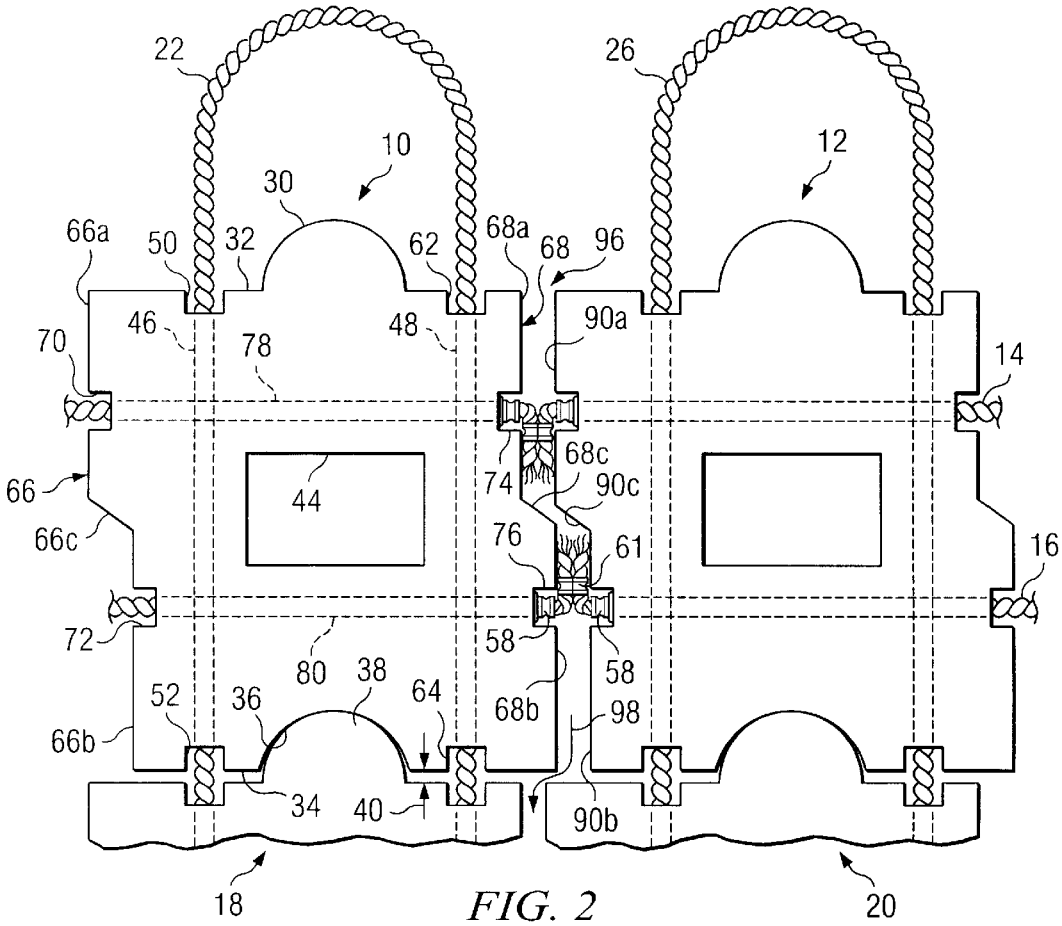
FIG. 2 is a top view of a portion of a mattress of erosion control blocks constructed according to an embodiment of the invention.

FIG. 1 depicts an erosion control block 10 constructed in accordance with the principles and concepts of the invention. FIG. 2 illustrates a portion of a mattress of erosion control blocks, utilizing the block of FIG. 1. Illustrated is a first block 10 cabled to a second adjacent block 12 by respective cables 14 and 16. The cables 14 and 16 can be of a 20 mm synthetic rope, or other cable suitable for underwater installation. The first block 10 is interengaged with a third block 18, only a portion of which is shown in FIG. 2. Similarly, the second block 12 is interengaged with a fourth block 20, a portion of which is shown. Blocks 10 and 18 are cabled together by a cable 22. Erosion control blocks 12 and 20 are cabled together by cable 26. It should be noted that each block of the mattress is identically constructed. This reduces the decision making by the installers who need not find and/or rearrange different-shaped blocks to form a mattress. A matrix of erosion control blocks can be constructed in the manner shown in FIG. 2, forming a mattress of six blocks by thirty-two blocks. By utilizing interengaging members between blocks, the flexibility of a mattress of cabled blocks is increased.

With particular reference to erosion control block 10, such block is preferably constructed of a 4000 psi concrete material suitable for underwater usage. In practice, the block 10 can be fabricated using block plant techniques, or other well-known erosion control block forming methods. The block 10 is generally rectangular-shaped, with lateral dimensions of about 15 inches by 15 inches, measured as if the block were square. The thickness of the block 10 can be made to achieve a desired weight of the block. For example, a block having a thickness of about four inches weighs about 50 lbs; a block of about six inches weighs about 63 lbs.; and a block of about eight inches weighs about 95 lbs. Erosion control blocks of different thicknesses can be utilized as a function of the velocity of the water encountered.

In accordance with an important feature of the invention, the block 10 is fabricated with a semicircular arm or lobe 30 formed as an extension laterally outwardly from edge 32. On the opposite edge 34 of the block 10, there is formed a semicircular recess 36. The lobe 30 of the block 10 can typically interengage with a recess of a neighboring block (not shown). The semicircular recess 36 of block 10 is shown interengaged with a lobe 38 of block 18. The diameter of the semicircular lobe 30 is about 4.125 inches, whereas the diameter by which the recess 36 is formed is about 4.875 inches. The engagement between the lobe of one block and the recess of another block is not an identical mate, but rather includes some slack or play, such as shown in FIG. 2 by the interengagement between the lobe 38 of block 18 and the recess 36 of block 10. In addition, the amount by which the lobe 30 extends outwardly from the edge 32 is greater than the amount by which the recess 36 is formed within the edge 34 of block 10. The mold for forming the block 10 is constructed such that when forming the lobe 38 and the recess 36, the blocks 10 and 18 are separated by about 0.5 inch when the lobe 38 is bottomed out within the recess 36 of block 10. The spacing between the blocks 18 and 10 is shown by reference numeral 40.

Figure 3:
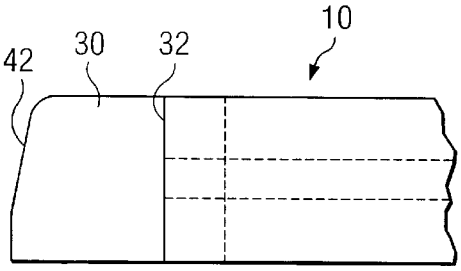
FIG. 3 is a side view of a portion of a block, showing the manner in which a corner of the lobe can be tapered to facilitate flexibility of the mattress of blocks.
Figure 7:
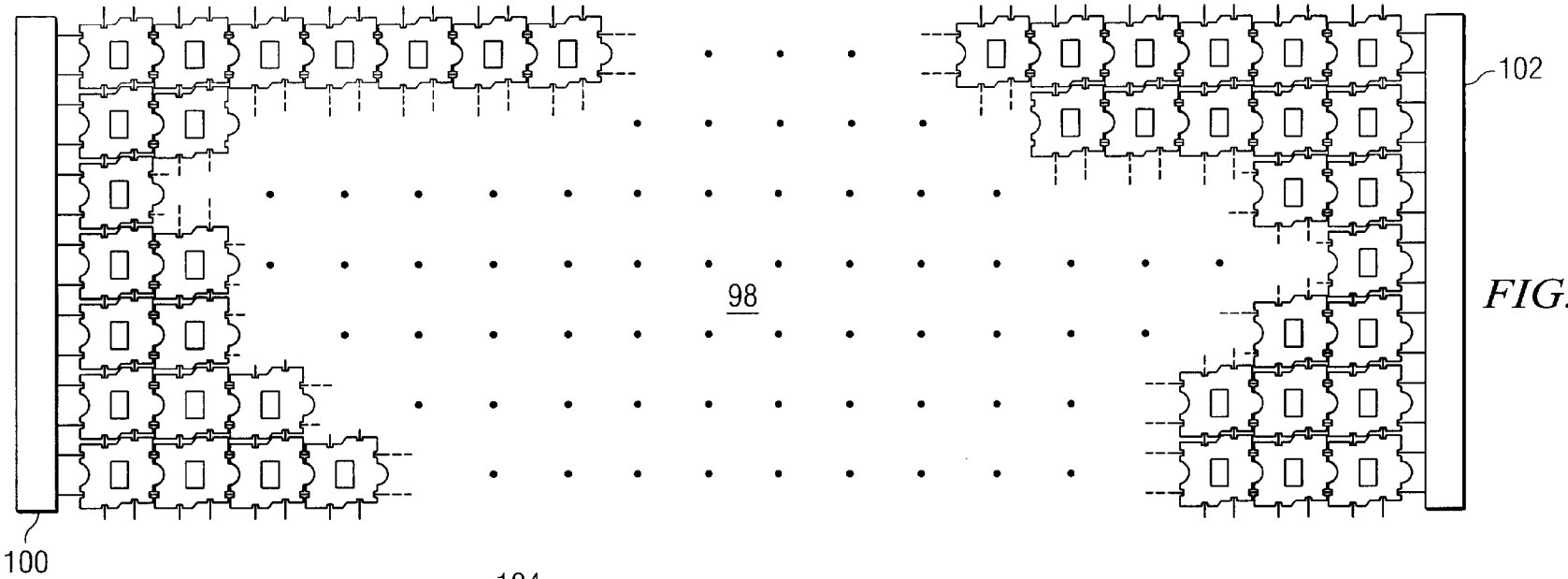
FIG. 7 is a top view of a mattress of erosion control blocks suspended by a portion of a spreader bar assembly.
Figure 8:
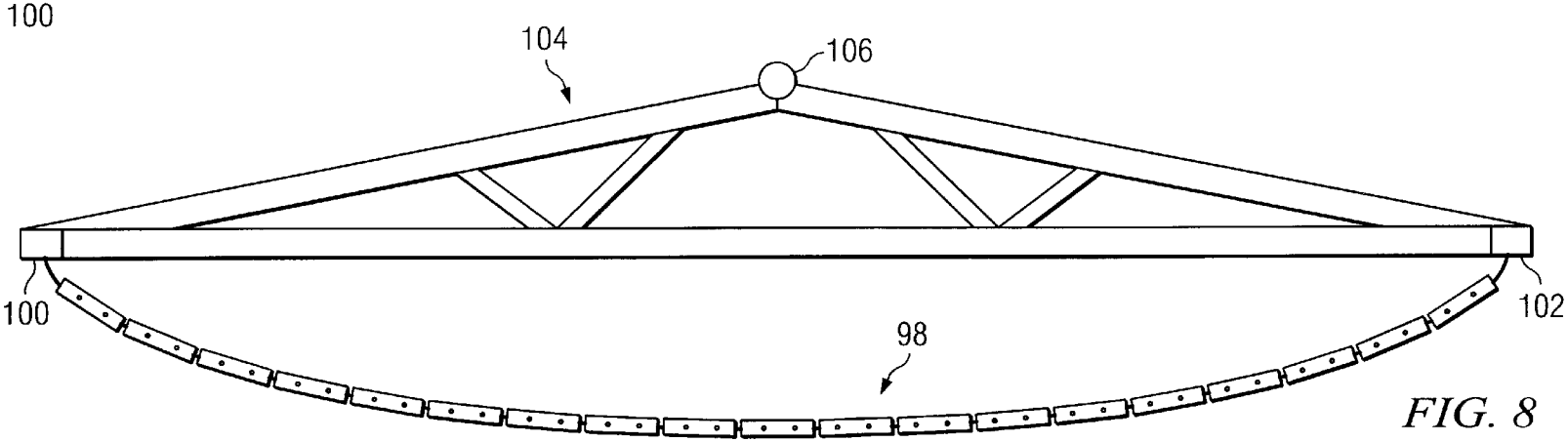
FIG. 8 is a side view of a spreader bar assembly with a mattress of erosion control blocks suspended therefrom.

In order to increase flexibility between neighboring blocks of a mattress, if desired, at least a portion of the peripheral rounded edge of the lobe 30 can be beveled or curved, as shown in FIG. 3. Here, the upper circular corner 42 is beveled so that when one block flexes with respect to a neighbor block, sharp edges do not rub or engage with the surfaces of a neighboring block. The blocks of a mattress will necessarily flex when arranged in a mattress and lifted by a spreader bar, such as shown in FIGS. 7 and 8, to be described below. In other modifications of the block 10, the bottom circular edge of the lobe 30 can also be beveled or rounded to reduce the destruction of corner edges when neighboring blocks become engaged under a compressive force.

With reference again to FIG. 2, there is formed in the block 10 an opening 44 centrally therein, from a top surface of the block to the bottom surface thereof. The opening 44 can be any shape and is for the purpose of allowing vegetation to grow through the block and facilitate anchoring of the block to the ground surface. In practice, the central opening 44 in the block 10 is about 3.5 inches by 6.13 inches. When a number of similar blocks are cabled together, with minimal space therebetween, the overall void area for the mattress of blocks is about twelve percent.

Four cable channels are formed in the block 10 for threading of the cables therethrough. A first cable channel 46 is formed through the block 10, between edge 32 and edge 34. Similarly, cable channel 48 is formed in the block 10, also between edge 32 and 34. The cable channels 46 and 48 are spaced-apart to accommodate the lobe 30 and the recess 36 therebetween. Each cable channel, for example cable channel 46, opens into a pocket or cavity 50 in a respective side edge of the block 10. In like manner, the other end of the cable channel 46 opens into a cavity 52 formed in the block side edge 34. The cavities 50 and 52 are formed so as to be about 0.75 inch deep into the respective edges 32 and 34, and about 1.5 inches wide. While the cavities 50 and 52 are shown formed from the top surface to the bottom surface of the block 10, such cavities can also be formed as individual pockets formed into the respective edges of the block 10. The cavities 50 and 52 function to allow a crimp button and washer to be secured to the cable 22. For example, the blocks forming the border of a matrix are often constrained from movement on cable 22 by the utilization of the crimp button and washers.

Figure 4:
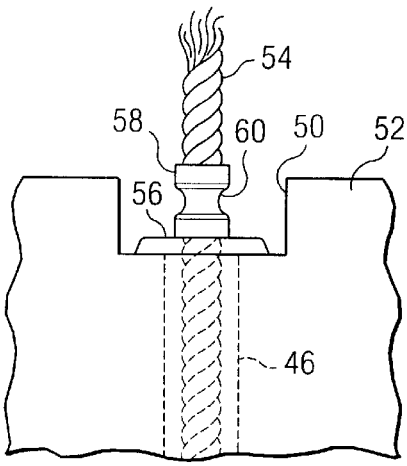
FIG. 4 illustrates the details of a cable channel cavity.

FIG. 4 illustrates in enlarged form, the manner in which a border block 52 is constrained with respect to a cable 54. A plastic washer 56 is placed flush against the inside surface of the cavity 50, and the cable 54 is threaded through the hole in the washer 56. Next, an aluminum crimpable button 58 is inserted over the cable 54, into engagement with the washer 56. By utilizing a conventional crimping tool, the button 58 is crimped to form one or more indentions 60 so as to securely clamp and anchor the button 58 to the cable 54. In this manner, the block 52 cannot move laterally on the cable, as the block 52 is constrained by the crimped button 58.

Figure 5:
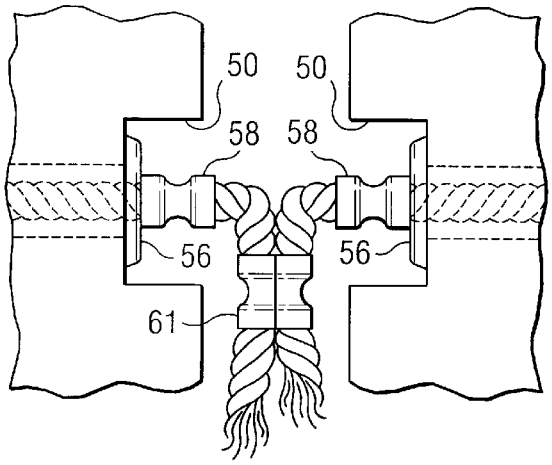
FIG. 5 shows a portion of two adjacent blocks on the border of two mattresses, with the cable cavities of each block aligned to provide sufficient room for splicing the mattress cable ends.

The cavity 50 allows additional space or room between neighboring blocks to allow a workman access to the ends of the cable 54 for installing the button 58 and washers 56 thereon. In practice, the border blocks of one mattress are spaced-apart from the border blocks of another mattress by about two inches or so, such as shown in FIG. 5. Here, there is shown a button 58 crimped to each end of the respective cables of the adjacent mattresses. In addition, the cable ends are spliced together with a double-tubular sleeve 61 that is crimped to the ends of the mattress cables. This anchors one mattress to an adjacent mattress. This spacing is sufficient to allow a workman access to the ends of the respective cables for splicing the same together.

By utilizing the cable cavities formed in each edge of the block 10, the spacing between border blocks of neighboring mattresses can be smaller, thereby reducing the chances of soil erosion thereunder. As can be appreciated, the unimpeded flow of water through a channel allows an increased flow rate of the water and the higher likelihood of either slope or mattress failure. If the flow of water is impeded in some manner, the flow rate is reduced, thereby reducing the possibility of slope or mattress failure. Those skilled in the art may desire to utilize cable cavities having other shapes and sizes to suit the particular needs required by the installation. Cable cavities 62 and 64 are formed in the respective block edges 32 and 34 of block 10 to accommodate the cable 22 in the same manner described above.

In addition to opposing block edges 32 and 34, the erosion control block 10 of FIG. 2 further includes other opposing block edges 66 and 68. Formed in the block edges 66 and 68 are respective cable cavities 70, 72 and 74, 76. The cavities 70 and 74 on opposing edges of the block 10 provide terminations for a cable channel 78. Similarly, cavities 72 and 76 formed in opposite edges of the block 10 provide terminations for a cable channel 80. Cable channel 78 has threaded therethrough the cable 14, while cable channel 80 has threaded therethrough cable 16. As such, four cables are threaded through respective channels of each block to provide stability to the block while lifting a mattress with a spreader bar.

Rather than being straight or linear, the side edge 66 of the block 10 has a first edge portion 66*a* that is parallel to a second edge portion 66*b*, but such edge portions 66*a* and 66*b* are not formed in the same vertical plane. Rather, edge portion 66*a* is connected to edge portion 66*b* by an angled edge section 66*c*. With this arrangement, the edge portion 66*a* is offset with respect to the edge portion 66*b* as shown in FIG. 2. The offset is formed so that the edge portion 66*b* is closer to the center of the block, as compared to edge portion 66*a*.

The opposing side edge 68 of block 10 is similarly formed, with edge portions 68*a*, edge portion 68*b* and angled edge section 68*c*. Here, the edge portion 68*a* is closer to the center of the block 10, as compared to edge portion 68*b*. The distance across the block 10 between opposing edges 66*a* and 68*a* is the same as the distance across the block 10 between 66*b* and 68*b*.

The block 10 is formed with offset edge portions on opposing sides thereof to provide two distinct functions. First, the offset edge portions are complementary, as between neighboring blocks within a mattress, such as shown between blocks 10 and 12 in FIG. 2. The spacing between blocks 10 and 12 may exist between border blocks of two adjacent mattresses. If block 10 and block 12 are cabled together in the same mattress, then such blocks would contact each other and there would be little or no spacing. When formed as border blocks between two adjacent mattresses, the blocks 10 and 12 block edge 68*a* is about one and one half inch from the side edge portion 90*a* of block 12, and side edge portion 68*b* of block 10 is about one and one half inch from side edge portion 90*b* of block 12. Lastly, angled edge section 68*c* of block 10 is adjacent angled edge section 90*c* of block 12. However, the spacing between the angled edge sections 68*c* and 90*c* is not typically one and one half inch, but rather because of the angled configuration the spacing is less. One function of the offset edge portions of each block is that should one block of one mattress, for example block 20, shift downwardly with respect to adjacent block 10 of another mattress, angled edge section 90*c* will engage with angled edge section 68*c* of block 10, thereby preventing further downward movement of block 12. The stability of the mattress is thereby enhanced.

Figure 6:
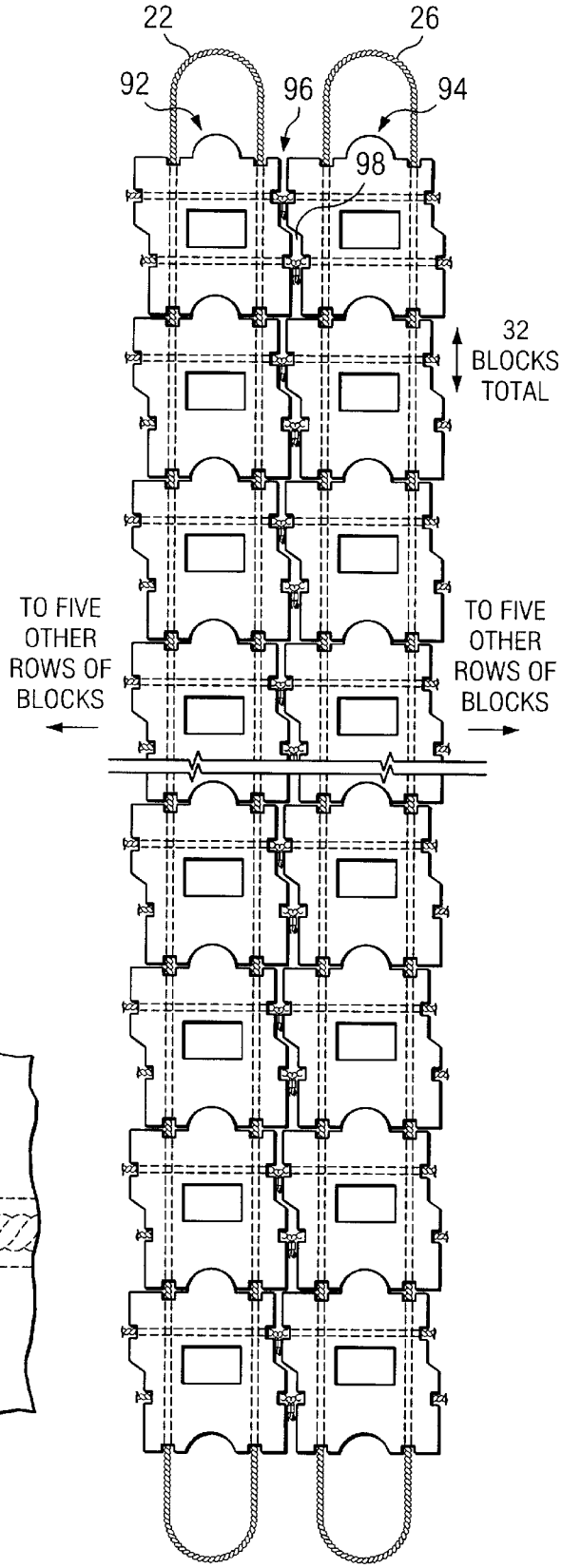
FIG. 6 illustrates a number of border blocks of two adjacent mattresses of erosion control blocks, illustrating the circuitous channel between the mattresses.

With reference now to FIG. 6, another advantage of the erosion control block of the invention is apparent. The thirty-two erosion control blocks in the row 92 are part of one mattress of blocks, and the thirty-two erosion control blocks in row 94 is part of another mattress. The loops in the cables 22 and 26 provide a mechanism for attaching the same to the spreader bar assembly 104. The spacing between the two rows 92 and 94 of blocks in neighboring mattresses constitutes a water channel 96. The ends of the cables extending between the two mattresses are spliced together in the water channel 96, using a splice such as identified by reference numeral 98. Splice 98 is the same as splice 61 of FIG. 5. As noted above, this ties or otherwise anchors the two adjacent mattresses together. In accordance with an important feature, the water channel 96 is circuitous, in that any runoff water cannot flow straight through the channel 96. Rather, any fluid flow between the two mattresses in the water channel 96 must change directions a number of times, thereby reducing the flow rate of water therethrough. The circuitous channel 96 between blocks 10 and 11 is shown in more detail in FIG. 2. In order for water to flow between two border blocks of adjacent mattresses, the water must first be re-routed when flowing through the channel defined by the edge section 68*c* and 90*c*. Next, the water must then abruptly change its direction of flow when exiting the water channel of one pair of adjacent blocks 10 and 12 and entering the water channel of the subsequent pair of blocks 18 and 20. This is shown by arrow 98 of FIG. 2. Then, when the water enters the channel of the subsequent blocks, it must again be redirected twice before entering the water channel of the next pair of blocks. As can be seen, when a mattress constitutes a minimum width of about six blocks, the water must change direction many times before passing entirely through the water channel of adjacent mattresses. The possibility of erosion of the soil underlying the blocks is thereby reduced. While only two opposing side edges are shown formed to provide a circuitous water channel between blocks, those skilled in the art may prefer to form all four sides of a block having edge configurations with portions 66*a*, 66*b* and angled edge section 66*c*.

FIG. 7 illustrates the top view of a number of erosion control blocks constructed according to the invention, anchored together by numerous cables. Each block of the mattress is constructed in a manner substantially identical to that shown in FIG. 1. The cables at the ends of the mattress are anchored to spaced-apart beams 100 and 102. The ends of the cables can be anchored to the beams 100 and 102 in any conventional manner well known in the field.

FIG. 8 illustrates a side view of a spreader bar assembly 104 coupled to the beams 100 and 102. The spreader bar assembly 104 includes a structure of heavy duty steel welded together so as to support the weight of the mattress when the spreader bar assembly 104 is lifted by a crane. Typically, an 80–100 ton crane is utilized for lifting the spreader bar assembly 104 by way of a hook or eye 106. As can be seen, the weight of the erosion control blocks constituting the mattress 98 causes it to bow downwardly and form an arc or catenary shape. The erosion control blocks are thus required to flex with respect to each other when suspended by the spreader bar assembly 104 and forced into the catenary shape. In order to prevent destruction of the semicircular lobes 30 due to point contact loading, the upper corners of the lobes can be angled or otherwise rounded, such as shown in FIG. 3.

Figure 9:
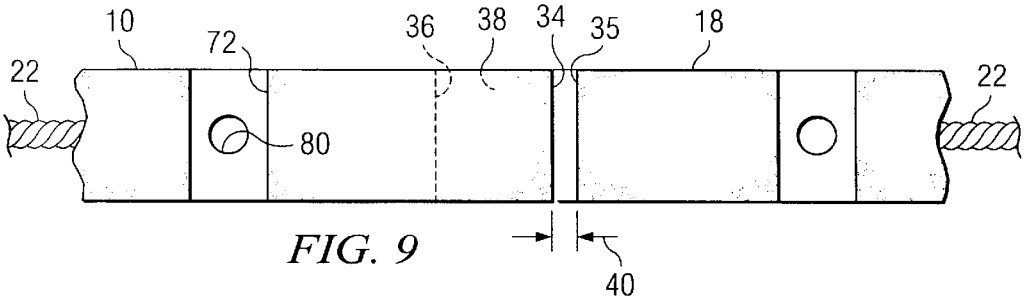
FIG. 9 is a side view of two erosion control blocks of FIG. 1, shown with the semicircular male and female members fully engaged, but with a spacing between the block edges.
Figure 10:
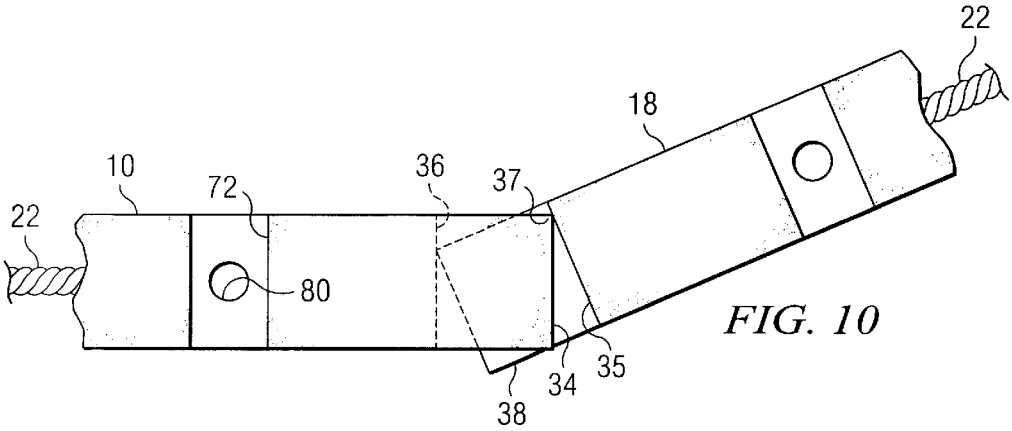
FIG. 10 is a side view of the blocks of FIG. 9, but where one block is flexed to such an extent that the adjacent block edges engage.

The flexibility of the block is shown by example in FIGS. 9 and 10. In FIG. 9, the blocks 10 and 18 of a mattress are shown with the semicircular male member 38 of block 18 fully engaged in the semicircular female member 36 of block 10. When both blocks 10 and 18 are on a generally planar surface, a space 40 exists between the adjacent edges 34 and 35 of the blocks 10 and 18. When the blocks 10 and 18 are angled, such as shown-in FIG. 10, the corner 37 of block 10 can be engaged with the side edge 35 of block 18. The angled orientation can occur when the blocks are picked up by a spreader bar and suspended by the cables threaded therethrough, or when installed on uneven terrain. The blocks can also flex in the opposite direction to a high degree, i.e., greater than 45°, to conform to sharp convex earth terrain such as involved with anchoring the edge of a mattress in a toe trench. In any event, even though the upper corner of the semicircular male member 38 engages with the sidewall of the semicircular female recess 36, the pressure exerted therebetween is reduced by the concurrent engagement of the adjacent side edges 34 and 35 of the blocks 10 and 18. This prevents breakage and chipping of the block members. As can be appreciated, the amount of flexing before the side edges of adjacent blocks engage is a function of the amount of the spacing 40.

Figure 11:
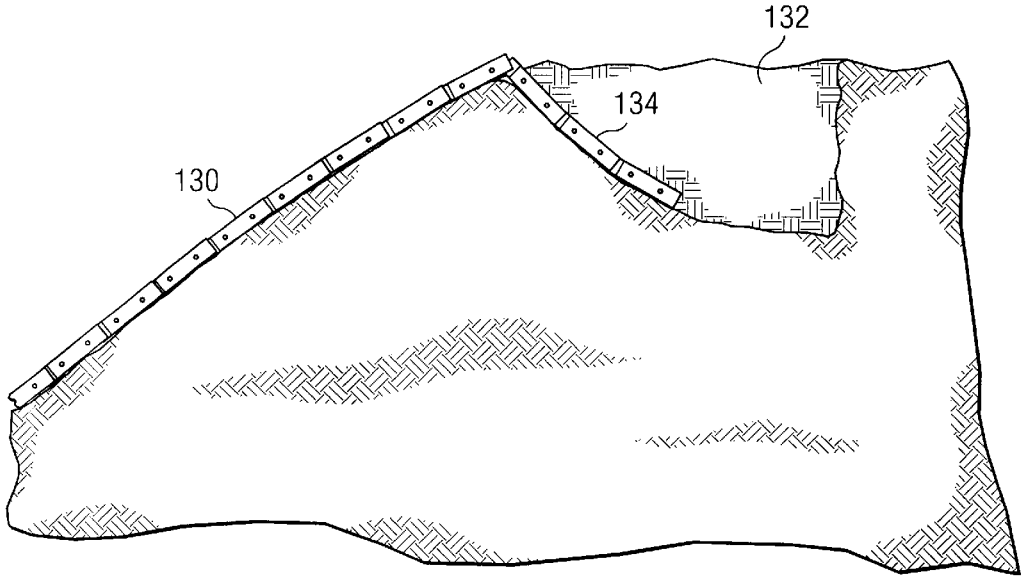
FIG. 11 is a cross-sectional view of the periphera of a mattress as buried in a toe trench.

FIG. 11 illustrates the manner in which the periphera of a mattress 130 is anchored in the ground to prevent water from flowing under the mattress 130 and/or the geotextile material. A toe trench 132 is formed in the ground at the periphera of the mattress 130, to a depth of about three feet. The edge or border blocks 134 of the mattress 130 are allowed to overlap into the trench 132. If the mattress 130 has a significant degree of flexibility, then fewer blocks of the mattress are required to reach to the bottom of the trench, as such blocks can be angled downwardly at a sharper angle. On the other hand, if the blocks do not have a significant amount of flexibility, then more blocks must be used for anchoring the mattress 130 in the toe trench 132. Once the edge blocks are installed in the toe trench 132, it is back filled and compacted with dirt.

Figure 12:
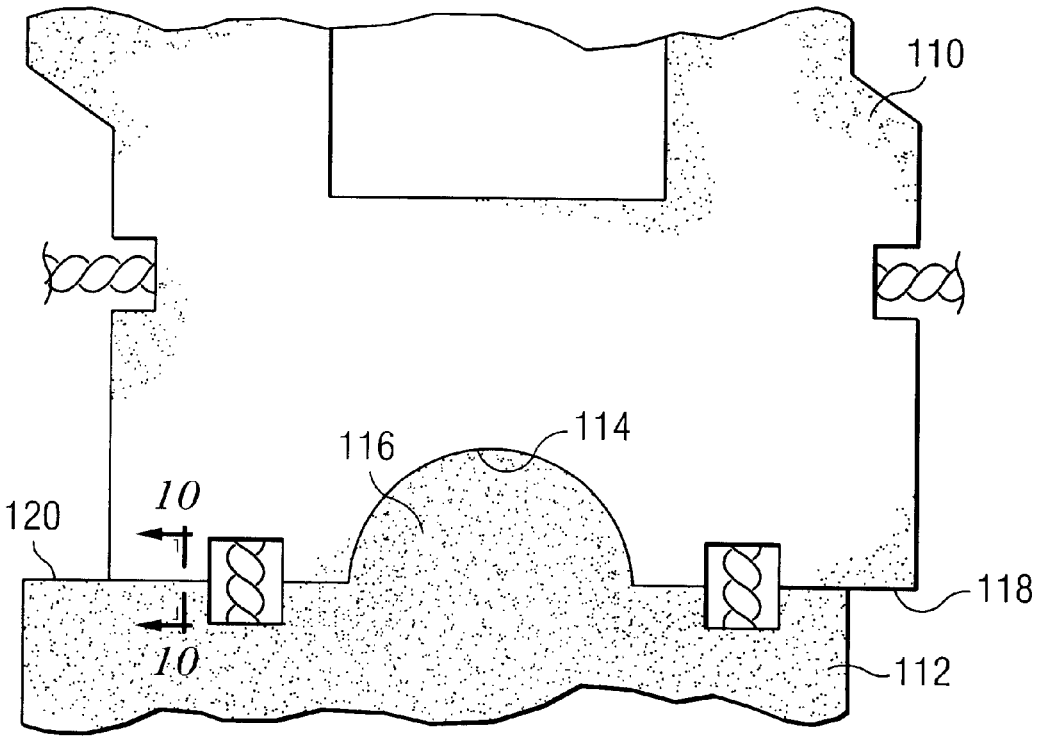
FIG. 12 illustrates another embodiment of an erosion control block, where the lobe and recess are formed to allow the edges of the block to engage each other.
Figure 13:
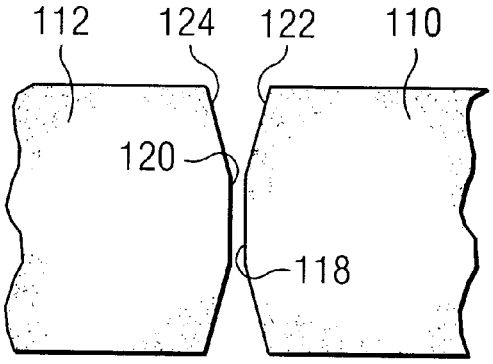
FIG. 13 is a partial cross-sectional view of the engaging edges of the blocks shown in FIG. 12.

FIG. 12 illustrates an embodiment similar to that shown in FIG. 2, but where the block 110 has a semicircular recess 114 which has substantially the same circumferential shape and length as the lobe 116 of block 112. With this configuration of the interengaging members, the side edge 118 of block 110 can engage or otherwise contact the side edge 120 of block 112. The lobe 116 of block 112 can have one or both circular corner edges thereof angled or rounded, such as shown in FIG. 3. Moreover, because of the engagement of the side edges 118 and 120 of respective blocks 110 and 112, such side edges can also include tapered or rounded corner edges, such as shown in FIG. 13. In order to accommodate the flexibility between blocks as shown in FIG. 8, when suspended from a spreader bar 104, the blocks 110 and 112 should preferably include rounded or angled top corner edges 122 and 124. Should it be required that the erosion control blocks flex in the opposite direction, so as to accommodate uneven terrain, the bottom corners of the side edges can also be rounded or angled, such as shown in FIG. 13.

The invention is susceptible to numerous modifications. For example, the cable cavities 52 and 62 can be eliminated, thereby providing a more sturdy and higher strength block, at least at the diagonal corners. Those skilled in the art may make yet other modifications which will come within the scope of the claims.

Figure 14A:
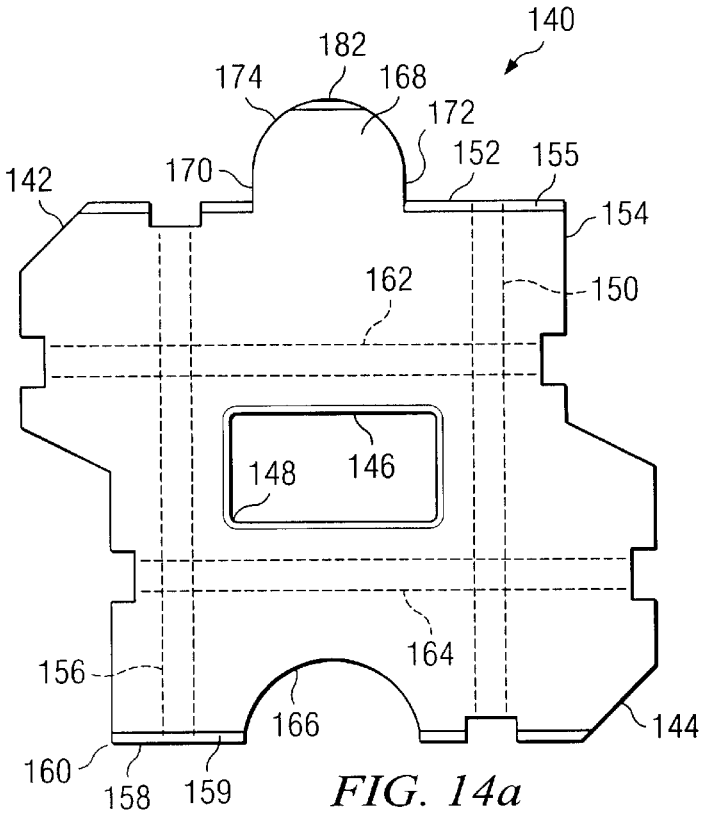
FIGS. 14*a*–14*c* are respective top, side and frontal views of an erosion control block according to another embodiment.
Figure 14B:
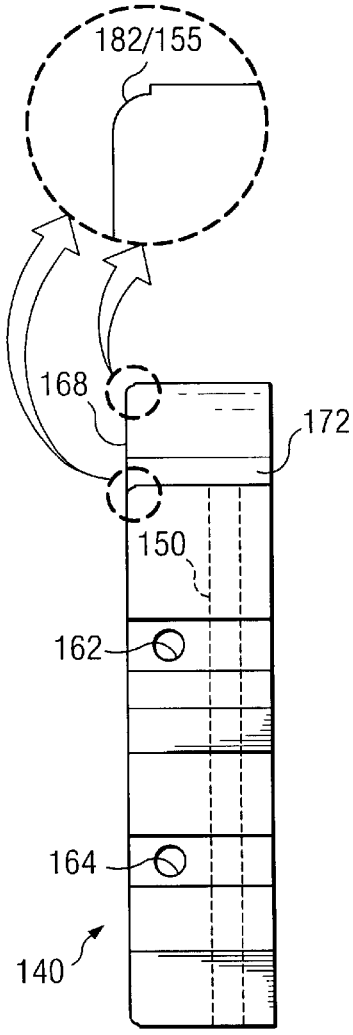
Figure 14C:
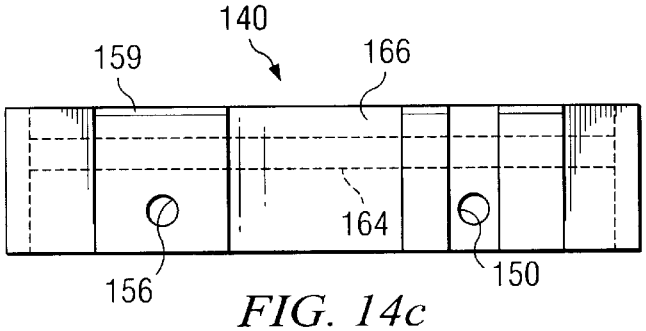

FIGS. 14*a*–14*c* illustrate respectively top, side and frontal views of an erosion control block 140, constructed according to another embodiment. The erosion control block 140 is similar to that shown in FIG. 2, with a few exceptions. Diagonal corners 142 and 144 are formed in the block 140 to increase the void area between blocks when a number of such blocks are cabled together to form a mattress. In the embodiment shown in FIG. 14*a,* the overall void area in a mattress of such type of blocks is about *18.34* percent. This includes the void area of the central opening 146, which measures about 3.5 inches by 6.115 inches. The corners 148 of the opening 146 are formed with curvature to facilitate removal of the block 140 from the mold with which it is formed.

In order to reduce the fragility of the block 140, the cable channel 150 opens into the edge 152 of the block 140, without the use of a corresponding cable cavity. The corner 154 of the block 140 is thus stronger and less susceptible to breakage. The cable channel 156 formed through the block 140 also terminates at the opposite block edge 158 without the use of a cable cavity. In like manner, the corner 160 of the block 140 is less susceptible to breakage. The pair of cable channels 162 and 164 each open into respective opposing cable cavities, much like the embodiment of the block 10 shown in FIG. 1.

Figure 15:
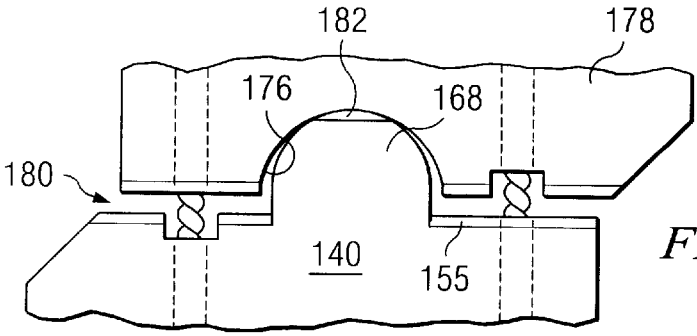
FIG. 15 illustrates the mating engagement of two blocks of FIG. 14*a,* with a space therebetween.

The block 140 is formed with a semicircular recess 166 into block edge 158. A lobe 168 is formed as an extension outwardly from the opposing block edge 152. The lobe 168 has opposing, parallel and linear side walls 170 and 172 that blend into the semicircular portion 174 of the lobe 168. As can be appreciated, when the lobe 168 of the block 140 is engaged within a recess 176 of a neighbor block 178 lying on a planar surface, such as shown in FIG. 15, a space 180 is provided therebetween. This allows flexibility of the blocks when cabled together and lifted off the ground for installation.

The side edge 152 of the erosion control block 140 is formed with a rounded upper corner 155, such as shown in the enlarged diagram of FIG. 14*b*. In like manner, the tip portion 182 of the lobe 168 is similarly rounded. The rounded upper corners 155 on the edge 152 as well as on the tip portion 182 of the lobe 168 facilitate the flexibility between engaged blocks, thereby reducing point contact loading of the edges and corresponding breakage or cracking of the blocks. The rounded upper corners 155 of the edge 152 and the tip portion 182 preferably have a radius of about 0.25 inches. Instead of utilizing rounded corners, a chamfer or other geometric shape can be utilized.

The opposite side edge 158 of the block 140 is similarly formed with a rounded upper corner 159 to reduce breakage of the corner of the blocks when neighboring blocks are engaged and flexed, such as when the cables are lifted for installation of a matrix or mattress of blocks.

Figure 16A:
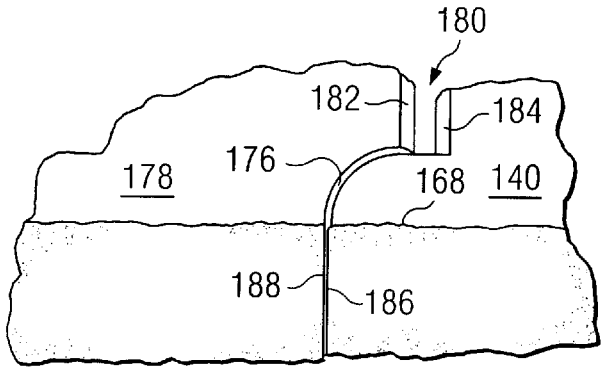
FIGS. 16*a*–16*c* are partial cross-sectional views of two blocks engaged together, at different stages in the process of lifting the same by cables.
Figure 16B:
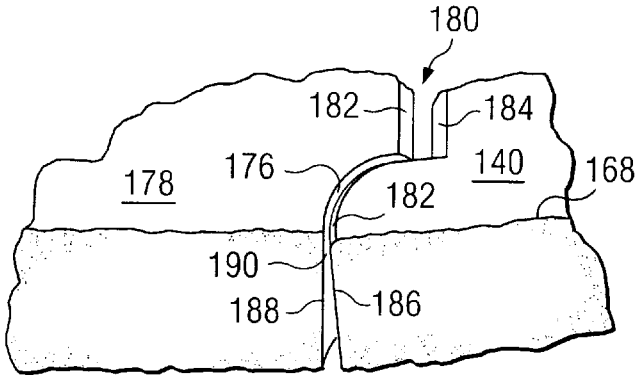
Figure 16C:
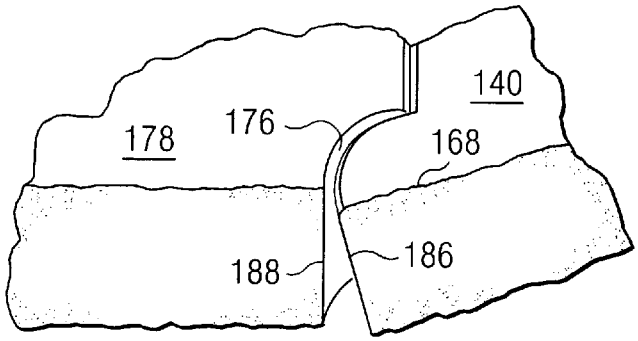

FIGS. 16*a*–16*c* illustrate the cooperation between the engaging surfaces/edges of neighboring blocks 140 and 178 of a row of erosion control blocks suspended by cables (not shown) in a catenary form. It is understood that block 178 is cabled by two cables through cable channels 150 and 156 (FIG. 14*a*) to block 140, as well as to many other similar blocks (not shown) in a row.

As can be appreciated, when cables are threaded through a number of erosion control blocks on a flat surface, the blocks 140 and 178 are pushed or otherwise forced together into contact with each other, as shown in FIG. 16*a*. Because the lobe 168 of block 140 is laterally longer than the recess 176 of neighbor block 178, the adjacent edges 186 and 188 of the respective lobe 168 and recess 176 are engaged together. This is also shown in FIG. 15. When both blocks 140 and 178 are lying on a planar surface, there exists a space 180 between the adjacent side edges of the blocks 140 and 178.

As the blocks 140 and 178 are in the early stage of being lifted by the spreader bar assembly 104 (FIG. 8), the blocks 140 and 178 begin to flex with respect to each other, such as shown in FIG. 16*b*. Here, the rounded edge 182 of lobe 168 engages the sidewall of the recess 176 of block 178. As noted above, the rounded upper corners 182 reduces point loading on the lobe corner, and facilitate flexing of the blocks during lifting to the catenary form. The rounded upper corner edges of the blocks 140 and 178 move closer to each other. This is shown in FIG. 16*b*.

After the spreader bar assembly 140 is lifted higher until all of the blocks are elevated off the ground, the blocks 140 and 178 flex even further, as shown in FIG. 16*c*. In this fully lifted position, the lobe 168 of block 140 no longer engages with the recess 176 of block 178. Rather, the rounded upper corner edges of the blocks 140 and 178 become engaged to support the force exerted between the blocks. Since there is substantially more surface area between the engaged rounded upper corner edges of blocks 140 and 178, as compared to the area between the recess 176 and lobe 168 (when engaged), the force exerted between engaged blocks 140 and 178 does not result in cracking or breakage of the engaged members.

After the blocks 140 and 178 have been moved by the crane to the installation side and laid on the area to be protected from erosion, the blocks flex in the opposite direction as shown in FIGS. 16*a*–16*c*. If the ground on which the blocks are laid is more or less level, the blocks will assume the position as shown in FIG. 16*a*. Here, the recess 176 of one block 178 will again engage with the lobe 168 of a neighbor block 140, and a space 180 will exist between the blocks. The space 180 between adjacent blocks can fulfill the requirements for a percentage of void area in a mattress of blocks, or provide an area for vegetation growth to further anchor the blocks to the ground.

While the erosion control blocks shown in the drawings are each constructed with one lobe and one recess, those skilled in the art may prefer to make blocks each having two recesses and two lobes. In addition, rather than providing side edges with irregular shapes to provide a circuitous space between neighbor blocks, such side edges can be generally linear While the preferred and other embodiments of the invention has been disclosed with reference to specific erosion control blocks, and methods of construction thereof, it is to be understood that many changes in detail may be as a matter of engineering choices, without departing from the spirit and scope of the invention, as defined by the appended claims.

What is claimed is:

1. A mattress of erosion control blocks, said mattress having peripheral erosion control blocks located on at least a portion of the periphery of the mattress, and central erosion control blocks located within a central portion of the mattress, said peripheral and central erosion control blocks comprising:

said peripheral erosion control blocks and said central erosion control blocks being substantially identical in shape so as to be interchangeable with each other;

each said erosion control block of said mattress constructed of heavy material having a top surface, a bottom surface and four side edges;

with a first and second opposing side edge having interengaging members for interengaging other erosion control blocks of of said mattress;

with a third and fourth opposing side edges of said erosion control block, a first edge portion of said third and fourth side edges being generally parallel to each other;

with a second edge portion of said third and fourth side edges being generally parallel to each other;

with a third angled edge section of said third and fourth side edges being generally parallel to each other, said third angled edge section of said third side edge coupling the first edge portion to said second edge portion, and said third angled edge portion of said fourth side edge coupling the first edge portion to said second edge portion of said fourth side edge; at least one cable channel formed through said erosion control block from one side edge to an opposing side edge; and with a recess formed in each side edge of opposing side edges of said erosion control block at respective locations where said cable channel opens to said opposing side edges, whereby when two said erosion control blocks are laid adjacent each other, a cable joining opening between the two blocks is formed to allow respective cables extending through the respective cable channels of the two adjacent blocks to be joined between the two blocks, and special erosion control blocks are not needed at edges of each mattress of said erosion control blocks.

2. The mattress of erosion control blocks of claim 1, wherein a side edge configuration of a fourth side edge of said block is complimentary-shaped with a third side edge of a neighboring block constructed substantially similar to said block.

3. The mattress of erosion control blocks of claim 1, wherein a distance between the first edge portions of said third side edge and said fourth side edge is substantially the same as a distance between the second edge portions of said third side edge and said fourth side edge.

4. The mattress of erosion control blocks of claim 1, further including at least two cable channels formed through said block, said cable channels formed orthogonal to each other.

5. The mattress of erosion control blocks of claim 1, further including a first pair of cable channels extending through said block between said first and second opposing side edges, and a second pair of cable channels extending through said block between said third and fourth side edges.

6. The mattress of erosion control blocks of claim 5, further including a respective recess formed at opposing ends of each said cable channel.

7. The mattress of erosion control blocks of claim 6, wherein said cable channel recesses are formed so as to join with respective cable channel recesses of neighboring blocks when placed adjacent to each other.

8. The mattress of erosion control blocks of claim 1, wherein said interengaging members comprise male and female members that are laterally separable from the respective female and male members of similar said blocks.

9. The mattress of erosion control blocks of claim 1, wherein said male and female members comprise respective semicircular lobe and a semicircular recess formed in said block, an axial axis of said lobe extending perpendicular to a top and bottom surface of said block.

10. The mattress of erosion control blocks of claim 9, wherein said axial axis of said semicircular lobe is displaced laterally outwardly from one side edge of said block.

11. The mattress of erosion control blocks of claim 1, wherein the male and female members of said block are shaped such that when the male member of the said block is fully engaged with a female member of a similar block, adjacent side edges of said engaged blocks are spaced-apart from each other.

12. The mattress of erosion control blocks of claim 1, wherein at least a corner portion of a circular edge of said male member is removed to thereby allow flexibility between engaged blocks.

13. The mattress of erosion control blocks of claim 12, wherein said corner portion is chamfered.

14. The mattress of erosion control blocks of claim 12, wherein said corner portion is rounded.

15. An erosion control block adapted for use in forming a mattress of similarly constructed blocks, comprising:

a block constructed of a heavy material, said erosion control block having first and third opposing side edges, and second and fourth opposing side edges, said second and fourth opposing side edges having engaging surfaces for engaging other similar-shaped erosion control blocks when arranged in a mattress;

said first side edge of each said erosion control block formed with a male interengaging member extending therefrom, said male interengaging member associated with a first half of the erosion control block;

said third side edge having a female member formed into said third side edge, said male and female members being complementary shaped, and said female interengaging member associated with a second half of said erosion control block that is different from said first half, said male member and said female member generally centered along a common linear axis of said block; and said first half of said erosion control block is offset from said second half so that a centerline between engaging side edges of said first half of said erosion control block is offset from a centerline between opposing engaging side edges of the second half of said erosion control block.

16. The erosion control block of claim 15, wherein the common linear axis of said male member and the female member is offset from the centerline associated with the first and the second half of said erosion control block.

17. An erosion control block, comprising:

a block constructed of a heavy material, said block having opposing side edges defined by a first side edge and a second side edge;

said first side edge having formed therein a recess, said recess opening between a top surface and a bottom surface of said block;

said second side edge having formed thereon an arm extending outwardly therefrom;

said first side edge having an upper corner and said second side edge having an upper corner, the upper corners of said first and second side edges having a shape other than square;

at least one cable channel formed through said block to couple together said block with a neighbor block of a similar construction; and said block being constructed such that when cabled with the neighbor block and disposed on a planar surface, and when the arm of said block is fully engaged in a recess of the neighbor block, a space exists between the second side edge of the block and a first side edge of the neighbor block, and when said block and the neighbor block are suspended in a catenary form by said cable, the upper corners of said second side edge of said block engage with an upper corners of a first side edge of the neighbor block.

18. The erosion control block of claim 17, wherein when said block and the neighbor block are suspended in a catenary form, a tip of the arm of said block and the recess of the neighbor block are not in contact with each other.

19. The erosion control block of claim 17, wherein when said block and the neighbor block are suspended in said catenary form, a corner of the arm of the block engages a side wall of the recess of the neighbor block.

20. The erosion control block of claim 19, wherein the corner of said arm is formed with a shape other than a square corner.

21. The erosion control block of claim 17, wherein said upper corners are rounded.

22. A method of fabricating an erosion control block, comprising the steps of:

forming a block having an arm extending from one side edge and a recess formed in an opposing side edge;

forming upper corners having respective rounded edges on each side of said arm and on each side of said recess;

forming said arm with a radial dimension greater than a radial depth of said recess, whereby when said arm of said block is fully engaged within a recess of a similarly constructed block lying on a planar surface, corresponding adjacent side edges of said engaged blocks are spaced apart, and when said engaged blocks are fully engaged together and one block is flexed with respect to the neighbor block about a horizontal axis, the upper corners of said corresponding adjacent side edges of said engaged blocks become engaged; and said upper corners having rounded edges to prevent breaking during engagement with the corresponding upper rounded corners of a neighbor block.

23. The method of claim 22, wherein said arm and recess are interengaging members.

24. The method of claim 22, wherein when the upper corners of the engaged blocks are in contact, the arm of one block is not in pressure contact with the recess of the neighbor block.

* * * * *